US008640748B2

(12) United States Patent
Chera

(10) Patent No.: US 8,640,748 B2
(45) Date of Patent: Feb. 4, 2014

(54) MULTIPLE LIQUID DISPENSER

(76) Inventor: Nathan Chera, Brooklyn, NY (US)

( * ) Notice: Subject to any disclaimer, the term of this patent is extended or adjusted under 35 U.S.C. 154(b) by 573 days.

(21) Appl. No.: 12/807,496

(22) Filed: Sep. 7, 2010

(65) Prior Publication Data

US 2012/0055584 A1 Mar. 8, 2012

(51) Int. Cl.
*B65B 1/04* (2006.01)
*A47G 33/00* (2006.01)

(52) U.S. Cl.
CPC ..... *A47G 33/002* (2013.01)
USPC ..... 141/243; 141/82; 141/234; 141/237; 141/242

(58) Field of Classification Search
USPC ..... 141/82, 100–105, 234–248; 222/146.6, 222/185.1; 62/390, 396–400
See application file for complete search history.

(56) References Cited

U.S. PATENT DOCUMENTS 172,687 A * 1/1876 Baeppler ..... 165/132
1,078,214 A * 11/1913 Patnaude ..... 62/397
1,520,136 A * 12/1924 Neff ..... 62/399
1,591,623 A * 7/1926 Hassensall ..... 222/185.1
1,662,267 A * 3/1928 Horner ..... 62/397
1,776,054 A * 9/1930 Tuttle ..... 141/82
2,034,300 A * 3/1936 Kellogg ..... 62/200
2,144,004 A * 1/1939 Wilson ..... 62/258
2,649,997 A * 8/1953 Klenk ..... 222/108
2,871,675 A * 2/1959 Cornelius ..... 62/258
4,204,613 A * 5/1980 Terzian et al. ..... 222/146.6
4,238,053 A * 12/1980 Bonini ..... 222/129.1
4,407,356 A * 10/1983 DeLau ..... 165/132
4,599,872 A * 7/1986 Rist ..... 62/399
5,226,296 A * 7/1993 Kolvites et al. ..... 62/390
5,743,107 A * 4/1998 Kyees ..... 62/390
6,047,866 A * 4/2000 Brown ..... 222/608
6,230,513 B1 * 5/2001 Reinmuth ..... 62/399
7,117,685 B2 * 10/2006 Wetherbee ..... 62/115
7,635,069 B2 * 12/2009 Spears ..... 222/108
2008/0237260 A1 * 10/2008 Wolek ..... 222/105

* cited by examiner

*Primary Examiner* — Timothy L Maust
(74) *Attorney, Agent, or Firm* — Ezra Sutton

(57) ABSTRACT

The present invention provides a multiple liquid dispenser having an upper section for receiving ice to form a cooling chamber. The cooling chamber has a spiral passageway extending through the ice having a plurality of layers of passageways. The spiral passageway has an upper end for receiving the liquid to be chilled by the surrounding ice and a lower end connected to multiple tubes for distributing the chilled liquid. The lower section has multiple liquid dispensers connected to the multiple tubes for receiving and dispensing the chilled liquid from the multiple liquid dispensers. The multiple liquid dispensers are spaced around the periphery of the lower section and has valves for opening and closing the liquid dispensers for dispensing the chilled liquid. A vertical stand is provided for supporting the upper and lower sections. A turntable is also provided for receiving the mounting stand and for receiving a plurality of drinking glasses for receiving the dispensed chilled liquid from the multiple liquid dispensers.

8 Claims, 2 Drawing Sheets

MULTIPLE LIQUID DISPENSER

FIELD OF THE INVENTION

The present invention relates to a liquid dispenser which includes a cooling chamber for cooling the liquid before it is dispensed from multiple separate dispensers.

BACKGROUND OF THE INVENTION

Although the prior art discloses many liquid dispensers, many of them do not have cooling chambers for holding and cooling the liquid before it is dispensed. In addition, many of the prior art dispensers do not include multiple dispensing heads, wherein each dispensing head separately dispenses the liquid. Some examples of the prior art are discussed below.

U.S. Pat. No. 5,351,861 entitled "Beverage Dispenser Having Turntable-Supported Multiple Beverage Containers" discloses a rotary beverage dispensing device. It includes a turntable having an upstanding partition structure forming chambers facing away from the turntable rotational axis and a beverage container support mechanism in each chamber. Each beverage container has a downwardly directed discharge spout, and a shut-off valve to control the flow of liquid beverage through the spout. The dispensing device is especially designed for carbonated beverages and fruit juices, and enables the user to select different beverages for dispensing.

U.S. Pat. No. 5,350,086 entitled "Ice Chest Dispenser Having A Pre-Chill Coil" discloses an ice chest-type soft drink dispenser containing a body of ice in contact with a cold plate at the bottom thereof. The cold plate contains syrup and carbonated water tubes through which syrup and carbonated water passes, respectively. A pre-chill coil of a plurality of turns of tubing embedded in an aluminum body is provided, separate from the cold plate and the tubing is in fluid communication with the carbonated water tube and a source of carbonated water.

U.S. Pat. No. 5,494,644 entitled "Multiple Product Dispensing System Including Dispenser For Forming Use Solution From Solid Chemical Compositions" discloses a multiple product dispensing system that includes a plurality of use solution dispensers and a controller for selecting one of the dispensers according to a preset regimen (selecting different dispensers on different days of the week). Each dispenser dispenses a controlled concentration of use solution using a diluent delivery apparatus that delivers a diluent to form a liquid concentrate from a solid chemical composition. Also, the patent describes a foam reducer which reduces the kinetic energy of the make-up diluent prior to mixing with the liquid concentrate to reduce foaming. An unskilled operator may operate the dispensing system to dispense a use solution of carefully controlled concentration, and the controller will automatically select the proper dispenser according to the preset regimen, without any additional input on the part of the operator.

OBJECTS OF THE PRESENT INVENTION

Accordingly, it is an object of the present invention to provide a liquid dispenser which includes a cooling chamber for cooling the liquid before it is dispensed from multiple separate dispensers.

It is a further object of the present invention to provide multiple dispensing heads, wherein each dispensing head separately dispenses the liquid.

It is a further object of the present invention to provide a receiving cup having measurements for receiving and measuring the liquid to be dispensed.

SUMMARY OF THE INVENTION

The present invention provides a multiple liquid dispenser having an upper section for receiving ice to form a cooling chamber. The cooling chamber has a spiral passageway extending through the ice having a plurality of layers of passageways. The spiral passageway has an upper end for receiving the liquid to be chilled by the surrounding ice and a lower end connected to multiple tubes for distributing the chilled liquid. The lower section has multiple liquid dispensers connected to the multiple tubes for receiving and dispensing the chilled liquid from the multiple liquid dispensers. The multiple liquid dispensers are spaced around the periphery of the lower section and has valves for opening and closing the liquid dispensers for dispensing the chilled liquid. A vertical stand is provided for supporting the upper and lower sections. A turntable is also provided for receiving the mounting stand and for receiving a plurality of drinking glasses for receiving the dispensed chilled liquid from the multiple liquid dispensers.

DETAILED DESCRIPTION OF THE PREFERRED EMBODIMENT

Figure 1:
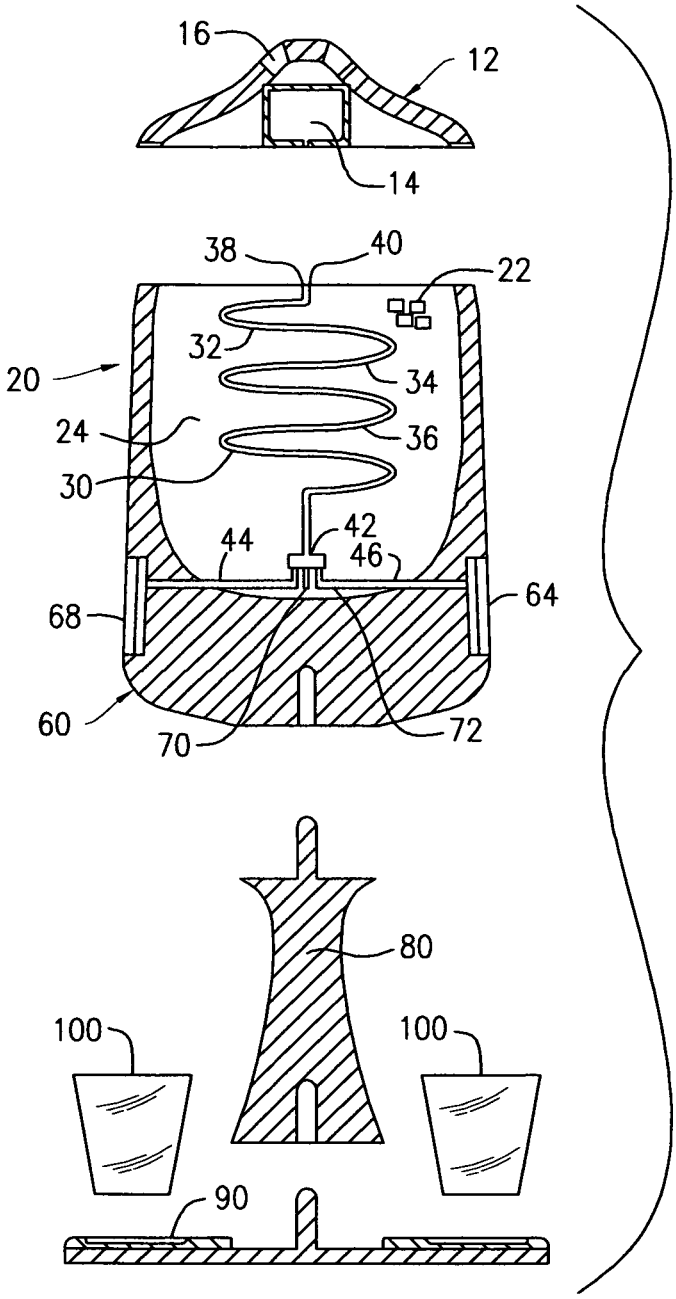
FIG. 1 shows a perspective view of the overall of the liquid dispenser, the vertical stand, and the turntable.
Figure 2:
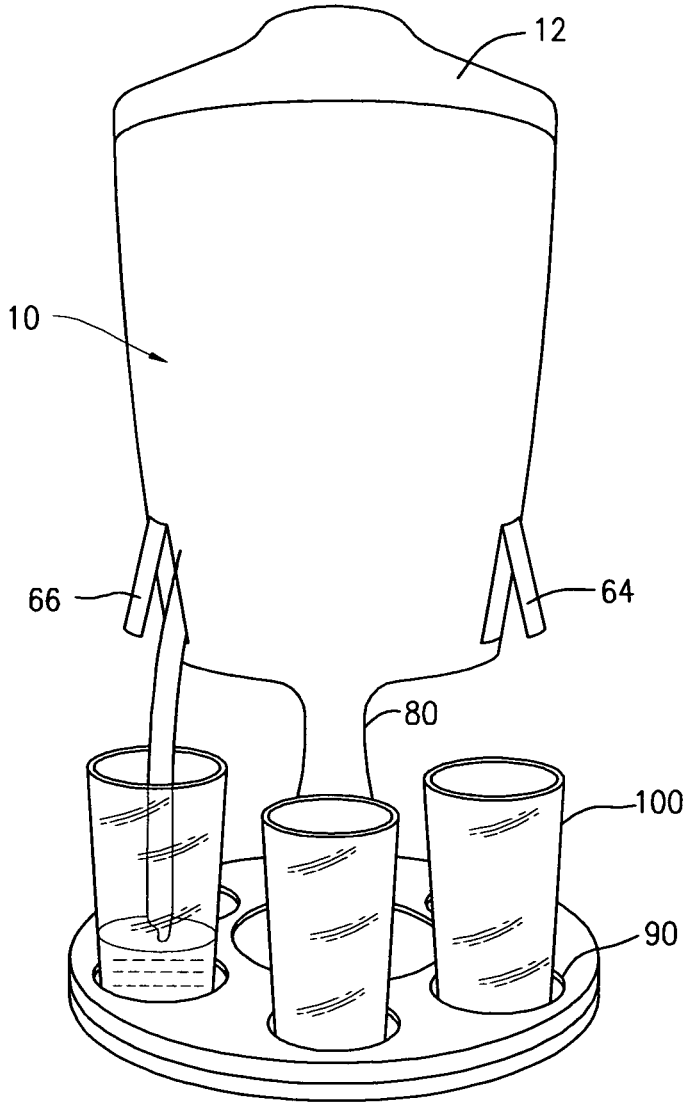
FIG. 2 shows a cross-sectional view of the cover, receiving cup, the cooling chamber, the spiral liquid passageway, the multiple dispensers, the vertical stand, and the turntable.

The present invention provides a multiple liquid dispenser 10 having a cover 12 and a liquid receiving cup 14 within the cover 12. The cover 12 includes liquid receiving holes 16 for receiving into cup 14 the liquid to be dispensed. In addition, the interior of the cup 14 is provided with measurement markings in the form of ounces in order for the user to measure how much liquid has been supplied to cup 14.

The present invention also includes an upper section 20 for receiving ice 22 to form a cooling chamber 24. The cooling chamber 24 has a spiral passageway 30 extending through the ice 22 having a plurality of layers of passageways 32, 34, and 36. The spiral passageway 30 has an upper end 40 for receiving the liquid to be chilled by the surrounding ice 22 and a lower end 42 connected to multiple tubes 44, 46, and 48 for distributing the chilled liquid. The upper end 40 includes a valve 38 for controlling the flow of liquid from cup 14 to spiral passageway 30. Also, the lower end 42 of spiral passageway 30 includes a valve 38 for controlling the flow of liquid from spiral passageway 30 to tubes 44, 46, and 48.

The present invention also includes a lower section 60 having multiple liquid dispensers 64, 66, and 68 connected to the multiple tubes 44, 46, and 48 for receiving and dispensing the chilled liquid from the multiple liquid dispensers 64, 66, and 68. The multiple liquid dispensers 64, 66, and 68 are spaced around the periphery of the lower section 60 and has valves 70, 72, and 74 for opening and closing the liquid dispensers 64, 66, and 68 for dispensing the chilled liquid.

The present invention also provides a vertical stand 80 for supporting the upper section 20 and lower section 60. A turntable 90 is also provided for receiving the vertical stand 80 and for receiving a plurality of drinking glasses 100 for receiving the dispensed chilled liquid 102 from the multiple liquid dispensers 64, 66, and 68.

It is noted that the present invention may be used to dispense any suitable liquid, including water, beverages, and alcohol. Also, it should be understood that the unit 10 may be made out of any suitable material, including stainless steel or plastic. Also, the number of dispensing heads may be varied from 1 to 10 in accordance with the present invention.

ADVANTAGES OF THE PRESENT INVENTION

The present invention provides the advantage of a liquid dispenser which includes a cooling chamber for cooling the liquid before it is dispensed from multiple separate dispensers.

Further, the present invention provides the advantage of multiple dispensing heads, wherein each dispensing head separately dispenses the liquid.

Further, the present invention provides the advantage of a receiving cup having measurements for receiving and measuring the liquid to be dispensed.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A multiple liquid dispenser, comprising:

a) an upper section for receiving ice to form a cooling chamber;

b) said cooling chamber having a spiral passageway extending through the ice having a plurality of layers of passageways;

c) said spiral passageway having an upper end having a valve for controlling the flow of the liquid to said spiral passageway to be chilled by the surrounding ice and a lower end having a valve for controlling the flow of the liquid from said spiral passageway to multiple distribution tubes for distributing the chilled liquid;

d) a lower section having multiple liquid dispensers connected to said multiple distribution tubes for receiving and dispensing the chilled liquid from the multiple liquid dispensers;

e) said multiple liquid dispensers being spaced around the periphery of said lower section and having means for opening and closing said liquid dispensers for dispensing the chilled liquid;

f) a vertical stand for supporting said upper and lower sections; and g) a base for receiving said mounting stand to support said dispensers.

2. A multiple liquid dispenser in accordance with claim 1, further including a liquid receiving cup having measurement markings in order for the user to measure the amount of liquid that is being supplied to said cup.

3. A multiple liquid dispenser in accordance with claim 2, further including a cover for housing said liquid receiving cup, wherein said cover includes liquid receiving holes formed therein for supplying to said cup the liquid to be dispensed.

4. A multiple liquid dispenser in accordance with claim 1, wherein said plurality of layers of said spiral passageways include at least three layers of horizontal layers of passageways.

5. A multiple liquid dispenser in accordance with claim 1, wherein said multiple liquid dispensers include at least four separate dispensing heads.

6. A multiple liquid dispenser in accordance with claim 1, wherein said base is a turntable and includes at least four separate glass receiving areas.

7. A multiple liquid dispenser, comprising:

a) an upper section for receiving ice to form a cooling chamber;

b) said cooling chamber having at least one passageway extending through the ice;

c) said at least one passageway having an upper end having a valve for controlling the flow of the liquid to said at least one passageway to be chilled by the surrounding ice and a lower end having a valve for controlling the flow of liquid from said at least one passageway to one or more distribution tubes for distributing the chilled liquid;

d) a lower section having one or more liquid dispensers connected to said one or more distribution connectors for receiving and dispensing the chilled liquid from said one or more liquid dispensers;

e) said one or more liquid dispensers being spaced around the periphery of said lower section and having means for opening and closing said liquid dispensers for dispensing the chilled liquid;

f) a vertical stand for supporting said upper and lower sections; and g) a base for receiving said mounting stand to support said dispenser.

8. A multiple liquid dispenser, comprising:

a) an upper section for receiving ice to form a cooling chamber;

b) said cooling chamber having at least one passageway extending through the ice;

c) said at least one passageway having an upper end having a valve for controlling the flow of the liquid to said at least one passageway to be chilled by the surrounding ice and a lower end having a valve for controlling the flow of liquid from said at least one passageway to one or more distribution tubes for distributing the chilled liquid;

d) a lower section having one or more liquid dispensers for receiving and dispensing the chilled liquid from said one or more liquid dispensers;

e) said one or more liquid dispensers being spaced around the periphery of said lower section and having means for opening and closing said liquid dispensers for dispensing the chilled liquid;

f) a vertical stand for supporting said upper and lower sections; and g) a base for receiving said mounting stand to support said dispenser.

* * * * *